US011087688B2

(12) United States Patent
Lin et al.

(10) Patent No.: US 11,087,688 B2
(45) Date of Patent: Aug. 10, 2021

(54) COMPENSATING METHOD FOR PIXEL CIRCUIT

(71) Applicant: BOE TECHNOLOGY GROUP CO., LTD., Beijing (CN)

(72) Inventors: Yi-Cheng Lin, Beijing (CN); Guang Yan, Beijing (CN); Quanhu Li, Beijing (CN); Mingi Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 135 days.

(21) Appl. No.: 15/779,789

(22) PCT Filed: Dec. 15, 2017

(86) PCT No.: PCT/CN2017/116383
§ 371 (c)(1),
(2) Date: May 29, 2018

(87) PCT Pub. No.: WO2018/201732
PCT Pub. Date: Nov. 8, 2018

(65) Prior Publication Data

US 2020/0035159 A1 Jan. 30, 2020

(30) Foreign Application Priority Data

May 5, 2017 (CN) ..... 201710310558.3

(51) Int. Cl.
*G09G 3/3258* (2016.01)

(52) U.S. Cl.
CPC ..... *G09G 3/3258* (2013.01); *G09G 2300/043* (2013.01); *G09G 2310/0243* (2013.01)

(58) Field of Classification Search
CPC ..... G09G 3/3258; G09G 2300/043; G09G 2310/0243; G09G 2310/0262;
(Continued)

(56) References Cited

U.S. PATENT DOCUMENTS 9,373,281 B2 * 6/2016 Wu ..... G09G 3/3233
2015/0339974 A1 * 11/2015 Wu ..... G09G 3/3233 345/690

(Continued)

FOREIGN PATENT DOCUMENTS

CN 103236237 A 8/2013
CN 203179479 U 9/2013

(Continued)

OTHER PUBLICATIONS

International Search Report from PCT Application No. PCT/CN2017/116383 dated Mar. 8, 2018 (3 pages).

(Continued)

*Primary Examiner* — David D Davis
(74) *Attorney, Agent, or Firm* — Dave Law Group LLC; Raj S. Dave

(57) ABSTRACT

Embodiments of the present disclosure provide a driving method for a pixel circuit. The pixel circuit includes a light emitting device and a drive transistor. The method includes: compensating the drive transistor in a first compensation manner including an internal voltage compensation during an operation period of the light emitting device; and compensating the drive transistor in a second compensation manner including the internal voltage compensation and an external voltage compensation during a non-operation period of the light emitting device.

18 Claims, 6 Drawing Sheets

(58) Field of Classification Search
CPC ..... G09G 2300/0842; G09G 2320/045; G09G 2300/0417; G09G 2300/0819; G09G 2230/00; G09G 2310/06; G09G 2320/0295; G09G 3/3233; G09G 3/3225
See application file for complete search history.

(56) References Cited

U.S. PATENT DOCUMENTS

| | | | | |
|---|---|---|---|---|
| 2016/0286622 | A1* | 9/2016 | Gai | G09G 3/3233 |
| 2016/0343304 | A1* | 11/2016 | Hwang | G09G 3/3258 |
| 2017/0018229 | A1* | 1/2017 | Zhang | G09G 3/3233 |
| 2017/0039944 | A1* | 2/2017 | Ma | G09G 3/325 |
| 2017/0206839 | A1 | 7/2017 | Wu et al. | |
| 2017/0270862 | A1* | 9/2017 | Zhang | G09G 3/3233 |
| 2017/0330511 | A1* | 11/2017 | Feng | G09G 3/3233 |
| 2019/0156747 | A1 | 5/2019 | Nie et al. | |

FOREIGN PATENT DOCUMENTS

| | | | |
|---|---|---|---|
| CN | 105280136 | | 1/2016 |
| CN | 105976761 | A | 9/2016 |
| CN | 106328061 | A | 1/2017 |
| CN | 106409225 | A | 2/2017 |
| KR | 20120061146 | A | 6/2012 |

OTHER PUBLICATIONS

Written Opinion from PCT Application No. PCT/CN2017/116383 dated Mar. 8, 2018 (4 pages).
European Search Report issued in EP Application No. 17899228.5, dated Sep. 18, 2020, 14 Pages.

* cited by examiner

COMPENSATING METHOD FOR PIXEL CIRCUIT

CROSS-REFERENCE TO RELATED APPLICATIONS

This application claims the benefit and priority of Chinese Patent Application No. 201710310558.3 filed on May 5, 2017, the entire content of which is incorporated herein by reference as a part of the present application.

TECHNICAL FIELD

The present disclosure relates to the display technology field, and more particularly, to a driving method for a pixel circuit.

BACKGROUND

In recent years, Active-Matrix Organic Light Emitting Diode (AMOLED) display devices have gradually become one of the focuses in the current display technology field. Compared to traditional liquid crystal displays, the AMOLED display device has characteristics such as ultra-high contrast, ultra-thin thickness, ultra-wide color gamut, a good viewing experience of a large viewing angle, and an ultra-fast response speed. Therefore, the AMOLED display device will take more market share in the future.

The AMOLED display device includes an organic light emitting diode array substrate. The organic light emitting diode array substrate includes an organic light emitting diode and a drive transistor for driving the organic light emitting diode. The threshold voltage (Vth) of the drive transistor is susceptible to drift, and in particular, the threshold voltage of the drive transistor made of an oxide material has a greater drift, which causes the current flowing through the organic light emitting diode to be changed, thereby making the display brightness uneven. Therefore, an external electrical compensation mechanism is required to compensate for the threshold voltage drift of the drive transistor to improve the display effect of the AMOLED display device.

SUMMARY

Embodiments described in the present disclosure provide a driving method for a pixel circuit. The drive method can compensate for the threshold voltage drift of the drive transistor in the pixel circuit.

According to a first aspect of the present disclosure, there is provided a driving method for a pixel circuit. The pixel circuit includes a light emitting device and a drive transistor. In the method, the drive transistor is compensated in a first compensation manner including an internal voltage compensation during an operation period of the light emitting device. The drive transistor is compensated in a second compensation manner including the internal voltage compensation and an external voltage compensation during a non-operation period of the light emitting device.

In embodiments of the present disclosure, the drive transistor is compensated in the second compensation manner at time intervals.

In embodiments of the present disclosure, in the step of compensating the drive transistor in the first compensation manner, the drive transistor is reset. Then, a voltage compensation is performed on the drive transistor. After that, a data signal is inputted to the pixel circuit. Following that, the light emitting device is driven to emit light.

In further embodiments of the present disclosure, inputting of the data signal to the pixel circuit is stopped prior to a voltage difference between a control electrode and a second electrode of the drive transistor is equal to a threshold voltage of the drive transistor.

In embodiments of the present disclosure, in the step of compensating the drive transistor in the second compensation manner, the drive transistor is reset. Then, a voltage compensation is performed on the drive transistor. After that, a data signal is inputted to the pixel circuit. Following that, a current flowing through the drive transistor is detected; an external compensation voltage is calculated based on the detected current; and a voltage of the data signal is compensated with the external compensation voltage.

In embodiments of the present disclosure, the pixel circuit includes a first transistor, a drive transistor, a second transistor, a capacitor, and a light emitting device. A control electrode of the first transistor is coupled to a first scan signal terminal, a first electrode of the first transistor is coupled to a data signal terminal, and a second electrode of the first transistor is coupled to a control electrode of the drive transistor. A first electrode of the drive transistor is coupled to a first power supply, and a second electrode of the drive transistor is coupled to an anode of the light emitting device. A control electrode of the second transistor is coupled to a second scan signal terminal, a first electrode of the second transistor is coupled to a sense signal terminal, and a second electrode of the second transistor is coupled to a second electrode of the drive transistor. A first terminal of the capacitor is coupled to the control electrode of the drive transistor, and a second terminal of the capacitor is coupled to the second electrode of the drive transistor. A cathode of the light emitting device is coupled to a second power supply.

In further embodiments of the present disclosure, the pixel circuit further includes a sensing element. The sensing element is coupled to the data signal terminal and the sense signal terminal.

In further embodiments of the present disclosure, in the step of compensating the drive transistor in the first compensation manner, the first transistor is enabled so that a voltage of the control electrode of the drive transistor is equal to a first voltage from the data signal terminal, and the second transistor is enabled so that a voltage of the second electrode of the drive transistor is equal to a second voltage from the sense signal terminal. Then, the first transistor continues being enabled and the second transistor continues being disabled so that the voltage of the second electrode of the drive transistor rises from the second voltage to a differential voltage between the first voltage and a threshold voltage of the drive transistor. After that, the first transistor continues being enabled, a data signal is provided to the data signal terminal to enable the drive transistor, and the second transistor continues being disabled, so that the voltage of the second electrode of the drive transistor continues rising to charge the capacitor. Following that, the first capacitor is disabled and the second transistor continues being disabled, so that the drive transistor continues being enabled with the holding function of the capacitor, so as to continue raising the voltage of the second electrode of the drive transistor by the first power supply to drive the light emitting device to emit light. The second voltage is lower than the first voltage.

In further embodiments of the present disclosure, in the step of compensating the drive transistor in the second compensation manner, the first transistor is enabled so that a voltage of the control electrode of the drive transistor is equal to a first voltage from the data signal terminal, and the second transistor is enabled so that a voltage of the second electrode of the drive transistor is equal to a second voltage from the sense signal terminal. Then, the first transistor continues being enabled and the second transistor continues being disabled so that the voltage of the second electrode of the drive transistor rises from the second voltage to a differential voltage between the first voltage and the threshold voltage of the drive transistor. After that, the first transistor continues be enabled, a data signal is provided to the data signal terminal to enable the drive transistor, and the second transistor continues being disabled so that the voltage of the second electrode of the drive transistor continues rising to charge the capacitor. Following that, the first capacitor is disabled, the second transistor is enabled, so that the drive transistor continues being enabled with the holding function of the capacitor, so as to continue raising the voltage of the second electrode of the drive transistor by the first power supply, causing the sense signal terminal to be in a floating state, so that a current flowing through the drive transistor is outputted to the sensing element, which calculates an external compensation voltage based on the current, and compensates the voltage of the data signal with the external compensation voltage. The second voltage is lower than the first voltage.

In embodiments of the present disclosure, the drive transistor is an N-type transistor.

In the driving method for a pixel circuit according to embodiments of the present disclosure, in the first and second compensation manners, the threshold voltage shift of the drive transistor can be compensated, the yield rate of the pixel circuit is improved, the hysteresis effect of the external voltage compensation is avoided, and the sensing charging rate for the external voltage compensation is accelerated. In addition, the driving method for a pixel circuit according to embodiments of the present disclosure can also compensate the mobility of the drive transistor.

BRIEF DESCRIPTION OF THE DRAWINGS

To describe technical solutions of the embodiments of the present disclosure more clearly, the accompanying drawings of the embodiments will be briefly introduced in the following. It should be known that the accompanying drawings in the following description merely involve some embodiments of the present disclosure, but do not limit the present disclosure, in which.

DETAILED DESCRIPTION

To make the objectives, technical solutions and advantages of the embodiments of the present disclosure clearer, the technical solutions in the embodiments of the present disclosure will be described clearly and completely below in conjunction with the accompanying drawings. Obviously, the described embodiments are merely some but not all of the embodiments of the present disclosure. All other embodiments obtained by those skilled in the art based on the described embodiments of the present disclosure without creative efforts shall fall within the protecting scope of the present disclosure.

Unless otherwise defined, all terms (including technical and scientific terms) used herein have the same meaning as commonly understood by those skilled in the art to which present disclosure belongs. It will be further understood that terms, such as those defined in commonly used dictionaries, should be interpreted as having a meaning that is consistent with their meaning in the context of the specification and will not be interpreted in an idealized or overly formal sense unless expressly so defined herein. As used herein, the description of "connecting" or "coupling" two or more parts together should refer to the parts being directly combined together or being combined via one or more intermediate components.

In all the embodiments of the present disclosure, a source and a drain (an emitter and a collector) of a transistor are symmetrical, and a current from the source to the drain (from the emitter to the collector) to turn on an N-type transistor is in an opposite direction with respect to the current from the source to the drain (from the emitter and the collector) to turn on an a P-type transistor. Therefore, in the embodiments of the present disclosure, a controlled intermediate terminal of the transistor is referred to as a control electrode, a signal input terminal is referred to as a first electrode, and a signal output terminal is referred to as a second electrode. The transistors used in the embodiments of the present disclosure mainly are switching transistors. In addition, terms such as "first" and "second" are only used to distinguish one element (or a part of the element) from another element (or another part of this element).

Hereinafter, embodiments of the present disclosure will be described by taking an OLED pixel circuit as an example. It should be understood by those skilled in the art that the embodiments of the present disclosure can also be applied to other current-driven pixel circuits, such as a Quantum Dot Light Emitting Diodes (QLED) pixel circuit.

Since the threshold voltage shift of the N-type transistor is relatively greater, an N-type transistor will be taken as an example to be described in the embodiments of the present disclosure. However, it should be understood by those skilled in the art that the embodiments of the present disclosure are also applicable to an OLED pixel circuit including P-type transistors.

Figure 1:
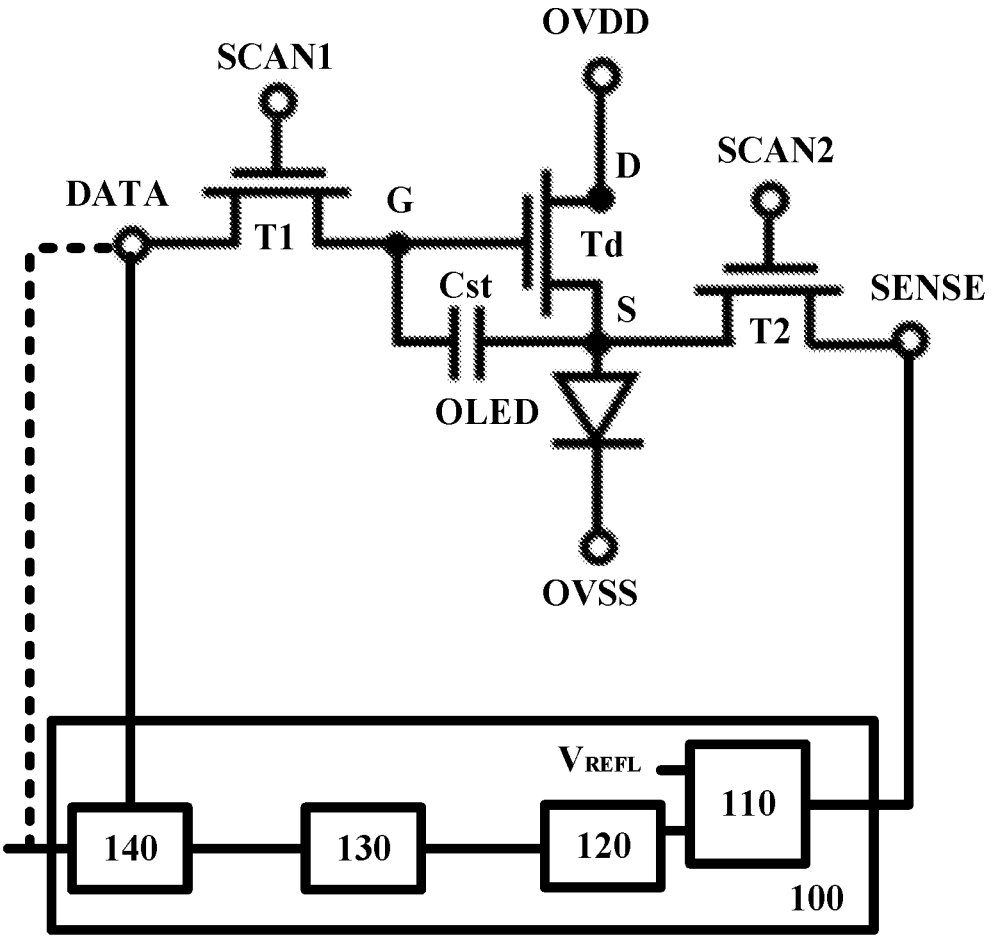
FIG. 1 is a schematic diagram of an example of an OLED pixel circuit.

FIG. 1 shows a schematic diagram of an example of an OLED pixel circuit. The OLED pixel circuit includes a first transistor T1, a drive transistor Td, a second transistor T2, a capacitor Cst, and a light emitting device OLED and a sensing element 100. A control electrode of the first transistor T1 is coupled to a first scan signal terminal SCAN1, a first electrode of the first transistor T1 is coupled to a data signal terminal DATA, and a second electrode of the first transistor T1 is coupled to a control electrode of the drive transistor Td. A first electrode of the drive transistor Td is coupled to a first power supply OVDD, and a second electrode of the drive transistor Td is coupled to an anode of the light emitting device OLED. A control electrode of the second transistor T2 is coupled to a second scan signal terminal SCAN2, a first electrode of the second transistor T2 is coupled to a sense signal terminal SENSE, and a second electrode of the second transistor T2 is coupled to a second electrode of the drive transistor Td. A first terminal of the capacitor Cst is coupled to the control electrode of the drive transistor Td, and a second terminal of the capacitor Cst is coupled to the second electrode of the drive transistor Td. A cathode of the light emitting device OLED is coupled to a second power supply OVSS. The sensing element 100 is coupled to the data signal terminal DATA and the sense signal terminal SENSE.

The sensing element 100 may include a port control circuit 110, a sensing circuit 120, a calculation circuit 130, and a voltage control circuit 140. The port control circuit 110 may control the state of the sense signal terminal SENSE to be in an output state or a floating state. In the output state, the sensing element 100 outputs a voltage VREFL through the sense signal terminal SENSE. In the floating state, the sensing element 100 may receive a current outputted from the second transistor T2 through the sense signal terminal SENSE. The sensing circuit 120 may detect the current received from the sense signal terminal SENSE. The calculation circuit 130 may calculate an external compensation voltage based on the sensed current. The voltage control circuit 140 is configured to add the external compensation voltage to the voltage of the data signal, as the voltage of the data signal. FIG. 1 merely schematically shows the sensing element 100. The port control circuit 110, the sensing circuit 120, the calculation circuit 130 and the voltage control circuit 140 in the sensing element 100 may be implemented by different devices, or may be integrated in one device.

Figure 2:
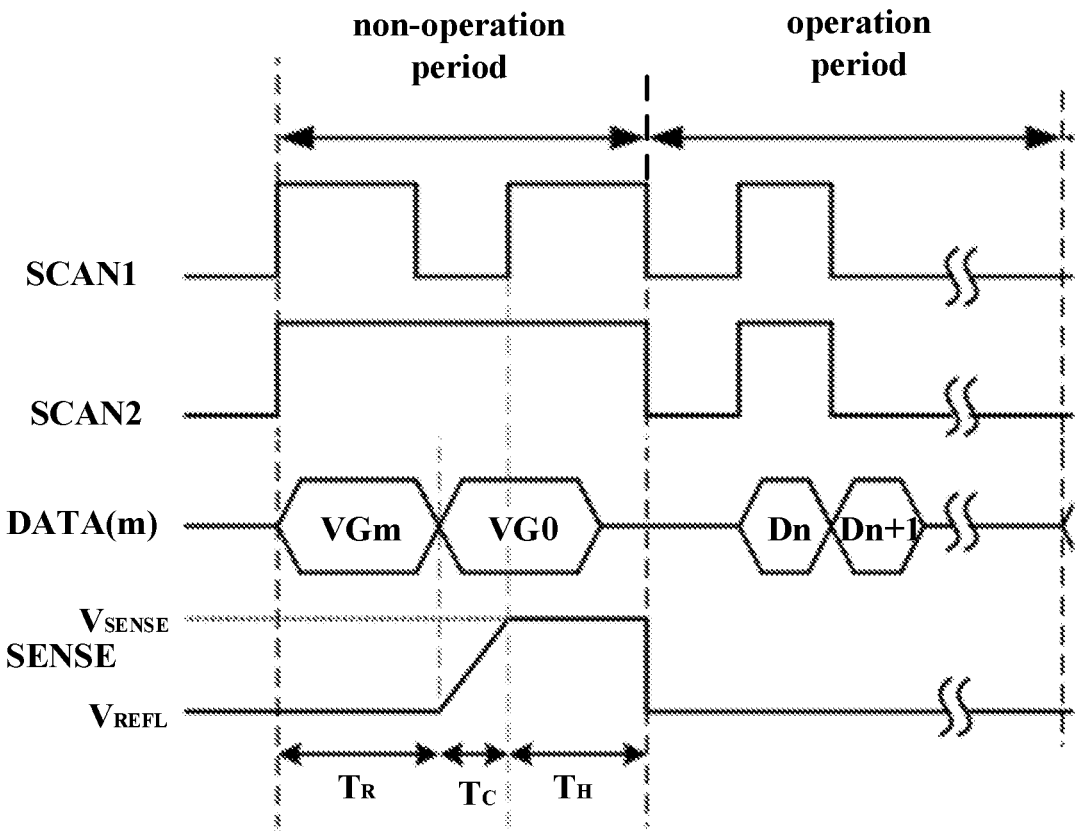
FIG. 2 is a timing diagram of each signal of the OLED pixel circuit as shown in FIG. 1 which is compensated in an external voltage compensation manner.

FIG. 2 is a timing diagram of each signal of the OLED pixel circuit as shown in FIG. 1 which is compensated in an external voltage compensation manner. During a non-operation period of the light emitting device, firstly in a TR phase, the drive transistor Td is reset by enabling the first transistor T1 and the second transistor T2 so that a voltage at node S is VREFL (VREFL is, for example, 0V). Then, in a Tc phase, the first transistor T1 is disabled and the second transistor T2 continues being enabled, so that the current flowing through the drive transistor Td is outputted to the sensing element 100 through the sense signal terminal SENSE. As can be seen in FIG. 2, in the Tc phase, the voltage of the sense signal terminal SENSE gradually rises. Finally, in a Tx phase, the sensing charge is completed. The first transistor T1 and the second transistor T2 are enabled, and the voltage of the sense signal terminal SENSE is maintained at $V_{SENSE}$. The sensing element calculates the voltage need to be compensated for adding the compensated voltage to the voltage of the data signal later on. In FIG. 2, as to the data signal terminal DATA, the maximum value of the voltage of the data signal terminal DATA is schematically represented by VGm, and the minimum value of the voltage of the data signal terminal DATA is schematically represented by VG0. During an operation period of the light emitting device, the data signals (Dn, Dn+1, . . . ) after compensation are used to drive the light emitting device OLED to emit light normally, which will not be described in detail herein.

Since the compensation accuracy of the external voltage compensation mechanism is not high enough, and the external voltage compensation is affected by the hysteresis effect of the thin film transistor, compensation distortion is caused. Furthermore, the external voltage compensation mechanism needs sufficient time and charging rate to achieve the optimal compensation effect. However, as the size of the display device increases and the resolution rises, the load of the sensing element also rises significantly, a slow sensing charging rate or insufficient charging is caused, which results in the desired compensation effect being not achieved. Therefore, as to the aforementioned problem, embodiments of the present disclosure provide a driving method for a pixel circuit.

Figure 3:
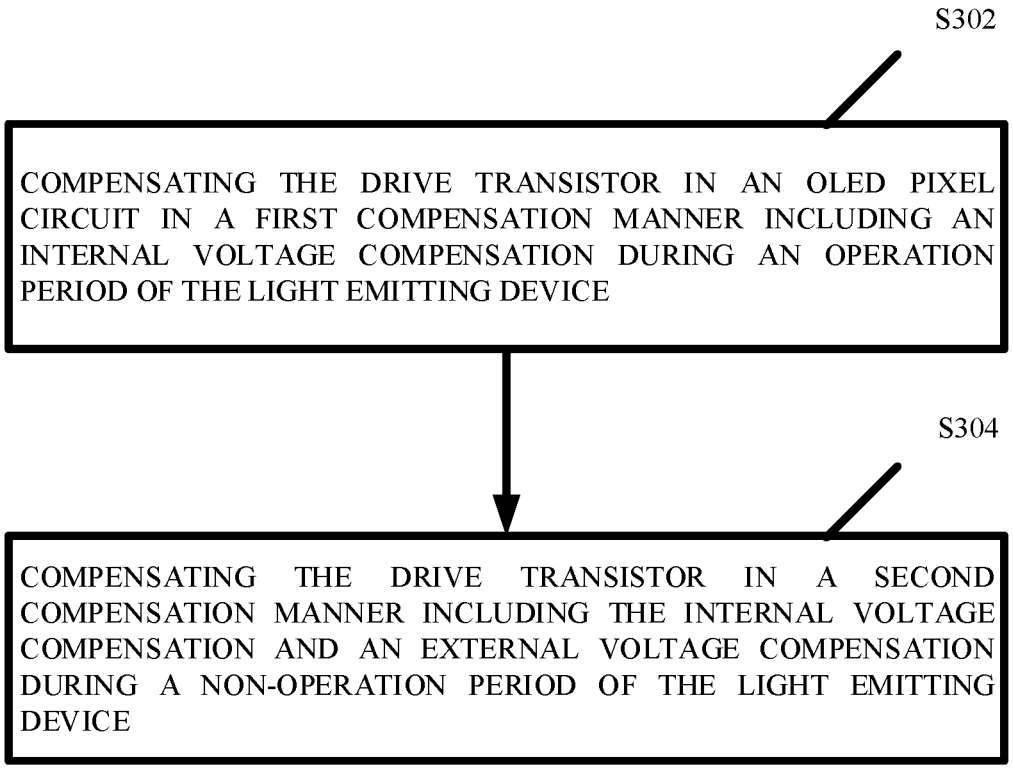
FIG. 3 is a schematic flowchart of a driving method for a pixel circuit according to an embodiment of the present disclosure.

FIG. 3 is a schematic flowchart of a driving method for a pixel circuit according to an embodiment of the present disclosure. As shown in FIG. 3, at S302, during an operation period of the light emitting device in the OLED pixel circuit, the drive transistor for driving the light emitting device in the OLED pixel circuit is compensated in a first compensation manner including an internal voltage compensation. In the embodiments of the present disclosure, the operation period of the light emitting device refers to a period during which the light emitting device is controlled to emit light, which may include a phase in which the light emitting device prepares to emit light and a phase in which the light emitting device emits light.

At S304, during a non-operation period of the light emitting device, the drive transistor is compensated in a second compensation manner including the internal voltage compensation and an external voltage compensation. In the embodiments of the present disclosure, the non-operation period of the light emitting device refers to a period during which the light emitting device is controlled not to emit light, for example, when the light-emitting device is in a phase during which the full screen is reset or when the light-emitting device is in a phase of an idle display between frames or rows.

In this method, the order of performing step S302 and step S304 is not limited. That is, step S304 may be performed before step S302.

In the driving method for a pixel circuit according to embodiments of the present disclosure, a small threshold voltage drift of the drive transistor may be compensated by an internal voltage compensation during an operation period of the light emitting device. However, the range of threshold voltage drift the internal voltage compensation can compensate is limited. After a long-term operation of the drive transistor, the threshold voltage drift gradually increases, and may exceed the range the internal voltage compensation can compensate. In the driving method for a pixel circuit according to embodiments of the present disclosure, the drive transistor is compensated in a second compensation manner including the internal voltage compensation and the external voltage compensation, during a non-operation period of the light emitting device. The second compensation manner can compensate a greater threshold voltage drift by the external voltage compensation and achieve a better compensation accuracy by the internal voltage compensation. In addition, since the second compensation manner is used during the non-operation period of the light emitting device, the driving method for the pixel circuit according to embodiments of the present disclosure does not affect the display effect negatively.

In an example, the drive transistor may be compensated in the second compensation manner at time intervals. For instance, the compensation for the drive transistor in the second compensation manner is performed once, after the full screen is scanned each time.

In the present embodiment, compensating the drive transistor in the OLED pixel circuit in the first compensation manner including an internal voltage compensation may include the following phases for example. In a reset phase, the drive transistor is reset. In a compensation phase, a voltage compensation is performed on the drive transistor. In a data-in phase, a data signal is inputted to the OLED pixel circuit. In a light emitting phase, the light emitting device is driven to emit light.

In the present embodiment, compensating the drive transistor in a second compensation manner including the internal voltage compensation and the external voltage compensation may include the following phases for example. In a reset phase, the drive transistor is reset. In a compensation phase, a voltage compensation is performed on the drive transistor. In a data-in phase, a data signal is inputted to the OLED pixel circuit. In a sensing phase, a current flowing through the drive transistor is detected, and the external compensation voltage is calculated based on the current. The calculated external compensation voltage is used to compensate the voltage of the data signal. In embodiments of the present disclosure, the external compensation voltage may be added to the voltage of the data signal, as the voltage of the data signal. Here, the external compensation voltage refers to a threshold voltage value that needs to be compensated by an external device on the basis that the internal voltage compensation has compensated a portion of the drifted threshold voltage.

Furthermore, the driving method for the pixel circuit according to embodiments of the present disclosure is not limited to be used for the OLED pixel circuit as shown in FIG. 1. It should be understood by those skilled in the art that the driving method for the pixel circuit according to embodiments of the present disclosure may be used for any variation of the OLED pixel circuit as shown in FIG. 1 (e.g. in any embodiments including both an internal voltage compensation unit and an external voltage compensation unit).

In the driving method for the pixel circuit according to embodiments of the present disclosure, the range and accuracy of the threshold voltage shift of the drive transistor that can be compensated may be improved by the second compensation manner including the internal voltage compensation and the external voltage compensation, and thus requirement on the drift range of the threshold voltage of the drive transistor in an OLED pixel circuit may be relaxed. That is, even if the range of the threshold voltage shift of the drive transistor to be manufactured may moderately exceed the conventionally approved qualification range, the drive transistor may still be considered to be qualified, so that the yield of manufacturing the OLED pixel circuit can be improved. Moreover, the internal voltage compensation performed in the second compensation manner can further avoid the hysteresis effect of the external voltage compensation and accelerate the sensing charging rate for the external voltage compensation.

Figure 4:
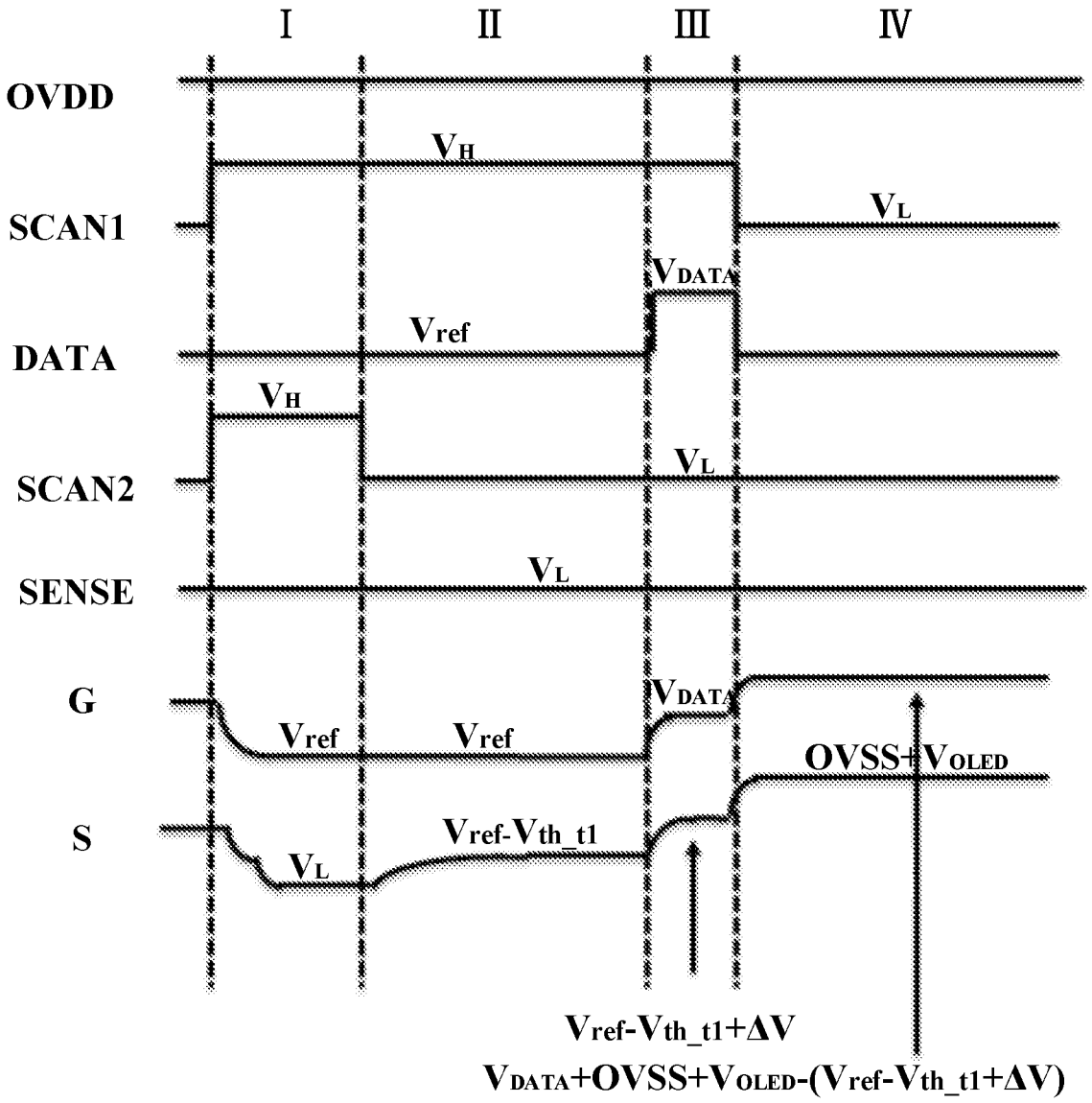
FIG. 4 is a timing diagram of each signal of the OLED pixel circuit which is compensated in a first compensation manner according to an embodiment of the present disclosure.
Figure 5:
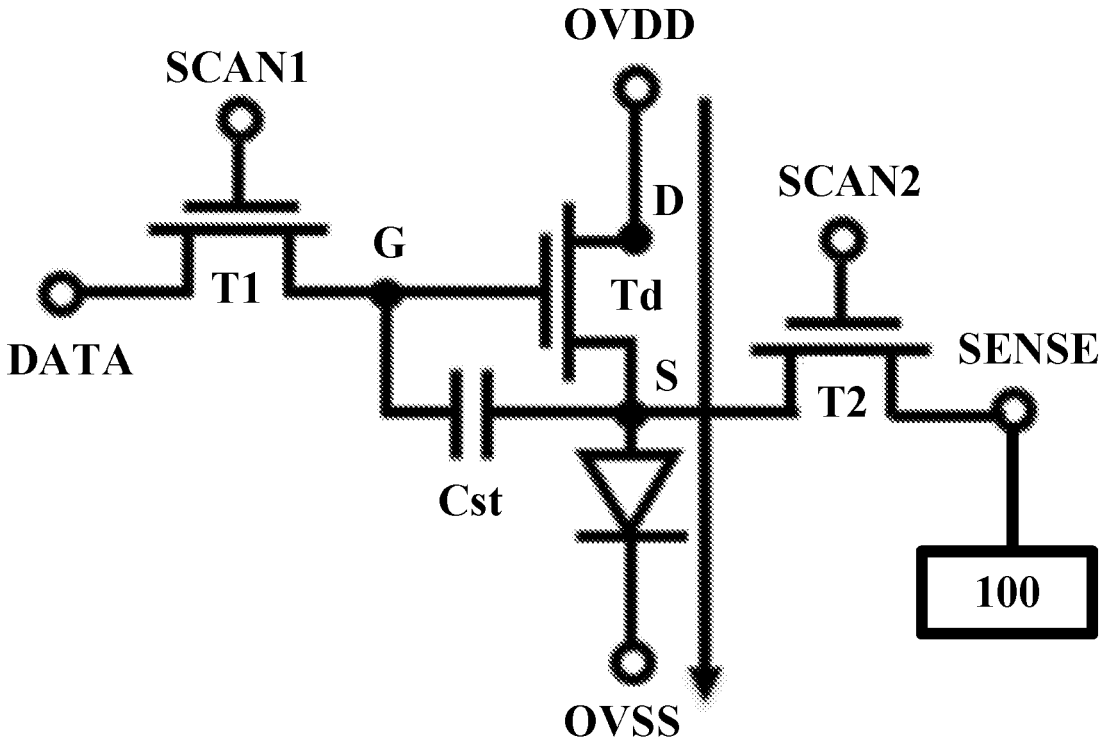
FIG. 5 is an exemplary schematic diagram of the OLED pixel circuit when using the timing diagram as shown in FIG. 4.

FIG. 4 shows a timing diagram of each signal of the OLED pixel circuit which is compensated in a first compensation manner according to an embodiment of the present disclosure. FIG. 5 shows an exemplary schematic diagram of the OLED pixel circuit when using the timing diagram as shown in FIG. 4. The process of driving the OLED pixel circuit in the internal voltage compensation manner during the operation period of the light emitting device OLED in the OLED pixel circuit will be described below with reference to the OLED pixel circuit as shown in FIG. 4. The process includes four phases: a reset phase, a compensation phase, a data-in phase, and a light emitting phase. Here, the operation period of the light emitting device OLED refers to a period including the four phases above.

In the reset phase (i.e., phase I), a high voltage $V_H$ is inputted to the control electrode of the first transistor T1 (i.e., the first scan signal terminal SCAN1 is at the high voltage $V_H$) to enable the first transistor T1 so that the voltage of the control electrode (i.e., node G) of the drive transistor Td is equal to the first voltage $V_{ref}$ from the data signal terminal DATA. The high voltage $V_H$ is inputted to the control electrode of the second transistor T2 (i.e., the second scan signal terminal SCAN2 is at the high voltage $V_H$) to enable the second transistor T2 so that the voltage of the second electrode (i.e., node S) of the drive transistor Td is equal to the second voltage $V_L$ from the sense signal terminal SENSE. Here, $V_L$ is set to be less than $V_{ref}$ (i.e., $V_L<V_{ref}$).

In the compensation phase (i.e., phase II), the first transistor T1 continues being enabled and the voltage of the data signal terminal DATA is maintained so that the voltage at node G is still $V_{ref}$. A second voltage $V_L$ is inputted to the control electrode of the second transistor T2 (i.e., the second scan signal terminal SCAN2 is at the second voltage $V_L$) to disable the second transistor T2 so that the voltage of the second electrode (i.e., node S) of the drive transistor Td rises from the second voltage $V_L$ to a differential voltage between the first voltage $V_{ref}$ and a threshold voltage $V_{th_t1}$ of the drive transistor Td (i.e., the voltage at node S is equal to $V_{ref}-V_{th_t1}$). In other words, the differential voltage between voltages of node G and node S is the threshold voltage $V_{th_t1}$ of the drive transistor Td.

In the data-in phase (i.e., phase III), the voltage at the data signal terminal DATA is changed into the third voltage $V_{DATA}$. The first transistor T1 continues being enabled. The voltage at node G is raised to $V_{DATA}$ by the voltage $V_{DATA}$ of the data signal from the data signal terminal DATA to enable the drive transistor Td. The second transistor T2 continues being disabled so that the voltage at the second electrode (i.e., node S) of the drive transistor Td continues rising. And the capacitor Cst is charged in this phase.

Figure 6:
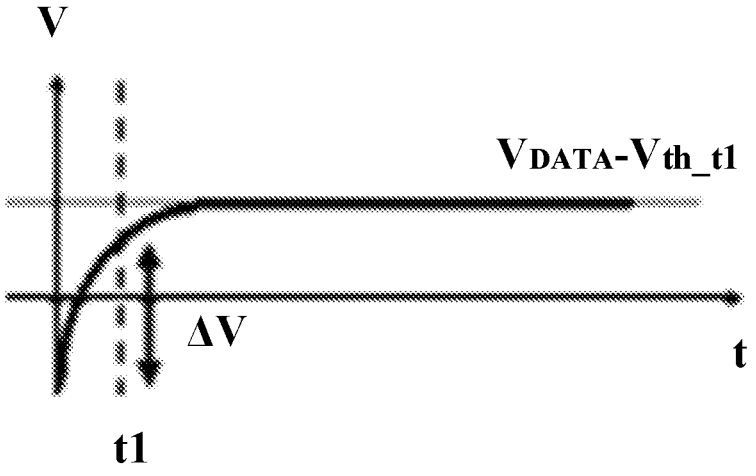
FIG. 6 is a schematic diagram for illustrating a voltage change at node S in the data-in phase as shown in FIG. 4.

FIG. 6 shows a schematic diagram of voltage change at node S in this phase. As the time t for inputting the data signal to the OLED pixel circuit increases, the voltage at node S gradually rises. For instance, at time t1, the voltage at node S rises by ΔV. Finally, the voltage at node S will reach an upper limit value $V_{DATA}-V_{th_t1}$ and maintain this voltage value. In the present embodiment, for instance, if the data-in phase is set to be ended at time t1, the voltage at node S is $V_{ref}-V_{th_t1}+\Delta V$. Thus, the voltage difference between voltages of node G and node S is $V_{GS}=V_{DATA}-(V_{ref}-V_{th_t1}+\Delta V)$.

In the light emitting phase (i.e., phase IV), the first transistor T1 is disabled and the second transistor T2 continues being disabled. The drive transistor Td continues being enabled with the holding function of the capacitor Cst. The voltage at node S is raised by the high voltage from the first power supply OVDD so as to cause the light emitting device OLED to emit light. The current flow direction in the OLED pixel circuit in this phase is shown by an arrow in FIG. 5. The voltage at node S is eventually raised to the sum (i.e., to $OVSS+V_{OLED}$) of the second power supply voltage OVSS and the light emitting voltage $V_{OLED}$ of the light emitting device OLED. Meanwhile, due to the holding function of the capacitor Cst, the differential voltage between voltages at node G and node S maintains the differential voltage $V_{GS}=V_{DATA}-(V_{ref}-V_{th_t1}+\Delta V)$ in the data-in phase, so the voltage at node G is finally raised to $V_{DATA}+OVSS+V_{OLED}-(V_{ref}-V_{th_t1}+\Delta V)$.

According to the following current calculation formula $$I_{OLED} = \frac{1}{2}\mu_n C_{ox}\frac{W}{L}(V_{GS} - V_{th_t1})^2$$

the following formula can be obtained $$\begin{aligned} I_{OLED} &= \frac{1}{2}\mu_n C_{ox}\frac{W}{L}(V_{DATA} - V_{ref} + V_{th_t1} - \Delta V - V_{th_t1})^2 \\ &= \frac{1}{2}\mu_n C_{ox}\frac{W}{L}(V_{DATA} - V_{ref} - \Delta V)^2 \end{aligned} \quad (1)$$

In formula (1), $\mu_n$ represents a carrier mobility of the drive transistor Td, $C_{ox}$ represents a gate oxide layer capacitance, and $$\frac{W}{L}$$

represents a width-length ratio of the drive transistor Td. As can be seen from formula (1), $I_{OLED}$ is not correlated with $V_{th_t1}$, and therefore the current fluctuation in the OLED pixel circuit caused by the deviation of the threshold voltage $V_{th_t1}$ of the drive transistor Td can be eliminated, thereby stabilizing the picture quality of the OLED. Furthermore, since $\Delta V$ is positively correlated with $\mu_n$, $\Delta V$ can be controlled by controlling the duration of inputting a data signal to the OLED pixel circuit, so as to compensate the carrier mobility $\mu_n$ of the drive transistor Td, thereby stabilizing the current $I_{OLED}$.

Figure 7:
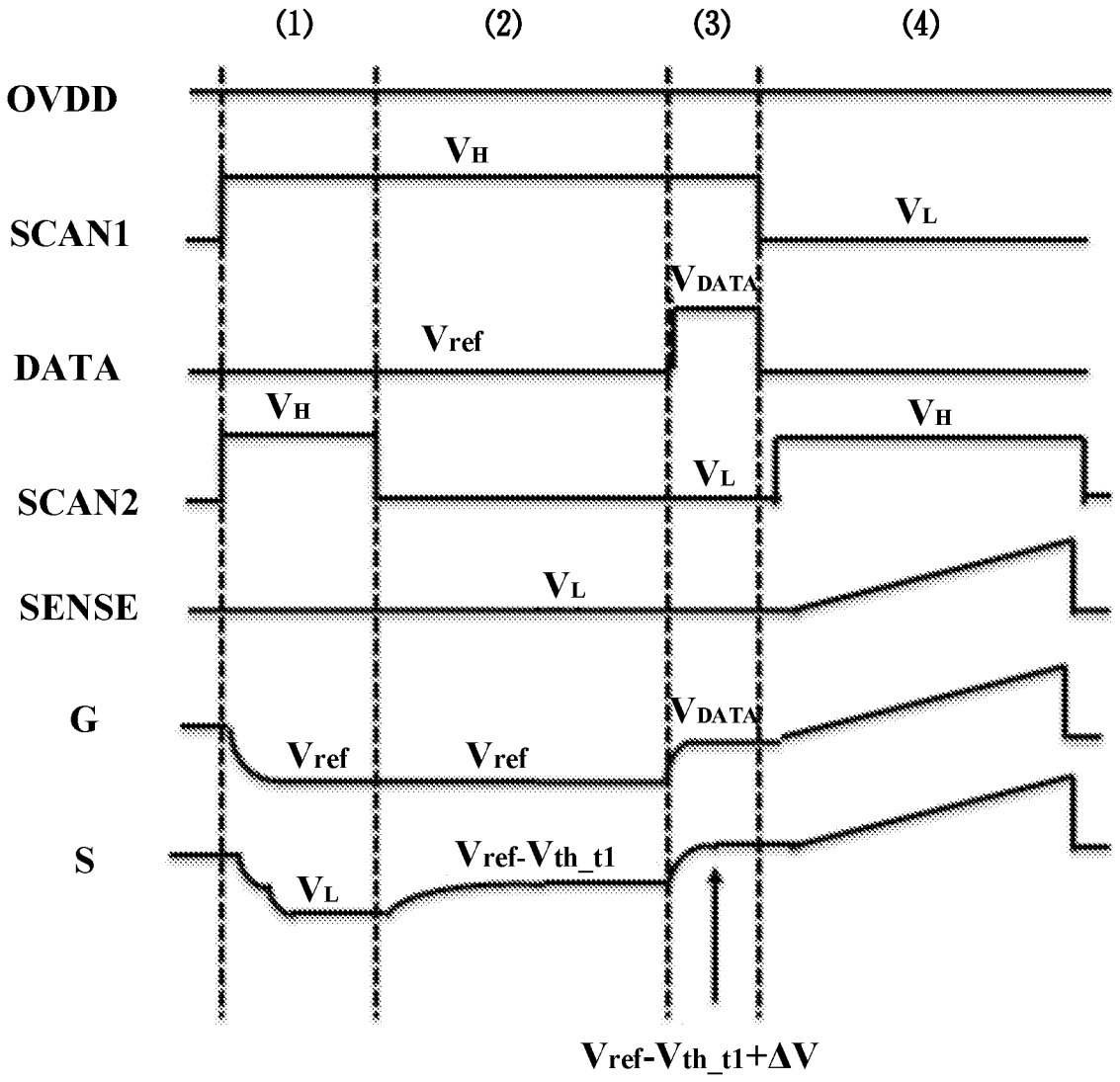
FIG. 7 is a timing diagram of each signal of the OLED pixel circuit which is compensated in a second compensation manner according to an embodiment of the present disclosure.
Figure 8:
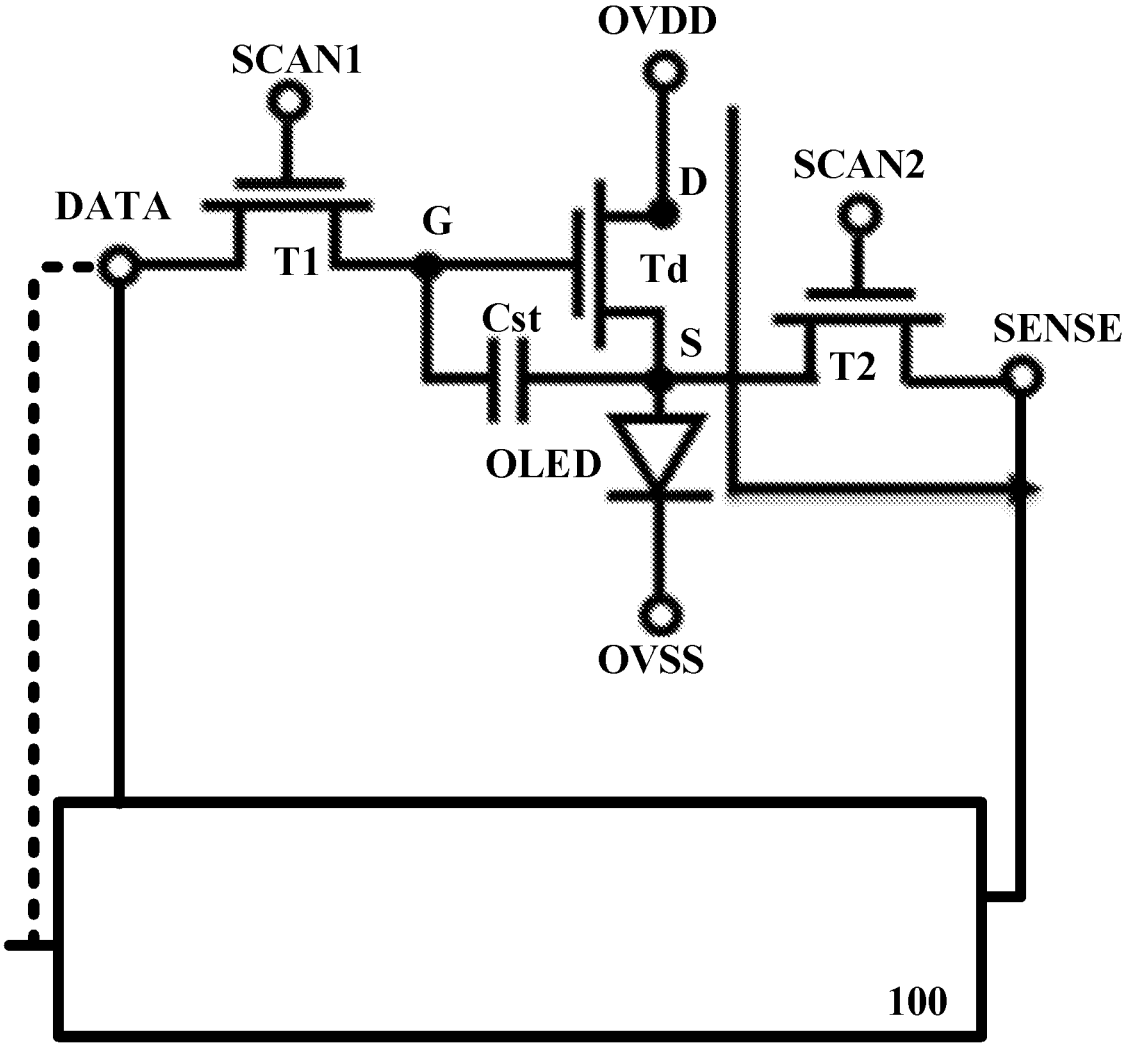
FIG. 8 is an exemplary schematic diagram of the OLED pixel circuit when using the timing diagram as shown in FIG. 7.

FIG. 7 is a timing diagram of each signal of the OLED pixel circuit which is compensated in a second compensation manner according to an embodiment of the present disclosure. FIG. 8 is an exemplary schematic diagram of the OLED pixel circuit when using the timing diagram as shown in FIG. 7. The process of driving the OLED pixel circuit in an manner including the internal voltage compensation and the external voltage compensation during the non-operation period of the light emitting device OLED in the OLED pixel circuit will be described below with reference to the OLED pixel circuit as shown in FIG. 8. The process includes four phases: a reset phase, a compensation phase, a data-in phase, and a sensing phase.

In the reset phase (i.e., phase (1)), the high voltage $V_H$ is inputted to the control electrode of the first transistor T1 (i.e., the first scan signal terminal SCAN1 is at the high voltage $V_H$) to enable the first transistor T1 so that the voltage of the control electrode (i.e., node G) of the drive transistor Td is equal to the first voltage $V_{ref}$ from the data signal terminal DATA. The high voltage $V_H$ is inputted to the control electrode of the second transistor T2 (i.e., the second scan signal terminal SCAN2 is at the high voltage $V_H$) to enable the second transistor T2 so that the voltage of the second electrode (i.e., node S) of the drive transistor Td is equal to the second voltage $V_L$ from the sense signal terminal SENSE. Here, $V_L$ is set to be less than $V_{ref}$ $V_L<V_{ref}$).

In the compensation phase (i.e., phase (2)), the first transistor T1 continues being enabled and the voltage of the data signal terminal DATA is maintained so that the voltage at node G is still $V_{ref}$. A second voltage $V_L$ is inputted to the control electrode of the second transistor T2 (i.e., the second scan signal terminal SCAN2 is at the second voltage $V_L$) to disable the second transistor T2 so that the voltage of the second electrode (i.e., node S) of the drive transistor Td rises from the second voltage $V_L$ to a differential voltage between the first voltage $V_{ref}$ and a threshold voltage $V_{th_t1}$ of the drive transistor Td (i.e., the voltage at node S is equal to $V_{ref}-V_{th_t1}$). In other words, the differential voltage between voltages of node G and node S is the threshold voltage $V_{th_t1}$ of the drive transistor Td.

In the data-in phase (i.e., phase (3)), the voltage at the data signal terminal DATA is changed into the third voltage $V_{DATA}$. The first transistor T1 continues being enabled. The voltage at node G is raised to $V_{DATA}$ by the voltage $V_{DATA}$ of the data signal from the data signal terminal DATA to enable the drive transistor Td. The second transistor T2 continues being disabled so that the voltage at the second electrode (i.e., node S) of the drive transistor Td continues rising. And the capacitor Cst is charged in this phase.

Similar to the data-in phase (i.e., phase III) in the process of driving the OLED pixel circuit in the first compensation manner, the voltage at node S rises to $V_{ref}-V_{th_t1}+\Delta V$. Thus, the voltage difference between voltages of node G and node S is $V_{GS}=V_{DATA}-(V_{ref}-V_{th_t1}+\Delta V)$.

In the sensing phase (i.e., phase (4)), the first transistor T1 is disabled and the second transistor T2 is enabled. The drive transistor Td continues being enabled with the holding function of the capacitor Cst. The voltage at node S is raised by the high voltage from the first power supply OVDD, and the sense signal terminal SENSE is set to a floating state by controlling the sensing element connected to the sense signal terminal SENSE. Therefore, the current flowing through the drive transistor Td will not flow to the light emitting device OLED but will flow to the sensing element through the sense signal terminal SENSE. The direction of current flow in the OLED pixel circuit in this phase is shown by an arrow in FIG. 8. The sensing element calculates the external compensation voltage based on the current, and adds the external compensation voltage to the voltage of the data signal, as the voltage of the data signal. Since the initial value ($V_{ref}-V_{th_t1}+\Delta V$) of the voltage at node S in the sensing phase is higher than the first voltage $V_{ref}$, the sensing charging rate in the sensing phase of the present embodiment is greater than that in the case of starting sensing charging from $V_{ref}$ as shown in FIG. 2. Furthermore, since the internal voltage compensation is performed first in the second compensation manner, the hysteresis effect of the external voltage compensation can be avoided.

In the driving method for a pixel circuit according to embodiments of the present disclosure, in the first and second compensation manners, the threshold voltage shift of the drive transistor can be compensated, the yield rate of the OLED pixel circuit is improved, the hysteresis effect of the external voltage compensation is avoided, and the sensing charging rate for the external voltage compensation is accelerated. In addition, the driving method for a pixel circuit according to embodiments of the present disclosure can also compensate the mobility of the drive transistor.

The display apparatus provided by the embodiments of the present disclosure may be used in any product having a display function, such as an electronic paper display, a mobile phone, a tablet computer, a TV set, a notebook computer, a digital photo frame, a wearable device or a navigation apparatus, and so on.

As used herein and in the appended claims, the singular form of a word includes the plural, and vice versa, unless the context clearly dictates otherwise. Thus, singular words are generally inclusive of the plurals of the respective terms. Similarly, the words "include" and "comprise" are to be interpreted as inclusively rather than exclusively. Likewise, the terms "include" and "or" should be construed to be inclusive, unless such an interpretation is clearly prohibited from the context. Where used herein the term "examples," particularly when followed by a listing of terms is merely exemplary and illustrative, and should not be deemed to be exclusive or comprehensive.

Further adaptive aspects and scopes become apparent from the description provided herein. It should be understood that various aspects of the present disclosure may be implemented separately or in combination with one or more other aspects. It should also be understood that the description and specific embodiments in the present disclosure are intended to describe rather than limit the scope of the present disclosure.

A plurality of embodiments of the present disclosure has been described in detail above. However, apparently those skilled in the art may make various modifications and variations on the embodiments of the present disclosure without departing from the spirit and scope of the present disclosure. The scope of protecting of the present disclosure is limited by the appended claims.

What is claimed is:

1. A driving method for a pixel circuit, wherein the pixel circuit comprises a light emitting device and a drive transistor, the driving method comprising:

compensating the drive transistor in a first compensation manner including an internal voltage compensation during an operation period of the light emitting device; and compensating the drive transistor in a second compensation manner during a non-operation period of the light emitting device, the second compensation manner including both the internal voltage compensation and an external voltage compensation.

2. The driving method according to claim 1, wherein the drive transistor is compensated in the second compensation manner at time intervals.

3. The driving method according to claim 2, wherein compensating the drive transistor in the first compensation manner comprises:

resetting the drive transistor;

performing a voltage compensation on the drive transistor;

inputting a data signal to the pixel circuit; and driving the light emitting device to emit light.

4. The driving method according to claim 3, wherein inputting of the data signal to the pixel circuit is stopped prior to a voltage difference between a control electrode and a second electrode of the drive transistor is equal to a threshold voltage of the drive transistor.

5. The driving method according to claim 4, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

6. The driving method according to claim 3, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

7. The driving method according to claim 2, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

8. The driving method according to claim 1, wherein compensating the drive transistor in the first compensation manner comprises:

resetting the drive transistor;

performing a voltage compensation on the drive transistor;

inputting a data signal to the pixel circuit; and driving the light emitting device to emit light.

9. The driving method according to claim 8, wherein inputting of the data signal to the pixel circuit is stopped prior to a voltage difference between a control electrode and a second electrode of the drive transistor is equal to a threshold voltage of the drive transistor.

10. The driving method according to claim 9, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

11. The driving method according to claim 8, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

12. The driving method according to claim 1, wherein compensating the drive transistor in the second compensation manner comprises:

resetting the drive transistor;

performing a voltage compensation on the drive transistor;

inputting a data signal to the pixel circuit; and detecting a current flowing through the drive transistor, calculating an external compensation voltage based on the detected current, and compensating a voltage of the data signal with the external compensation voltage.

13. The driving method according to claim 1, wherein the pixel circuit comprises a first transistor, a drive transistor, a second transistor, a capacitor, and a light emitting device, wherein a control electrode of the first transistor is coupled to a first scan signal terminal, a first electrode of the first transistor is coupled to a data signal terminal, and a second electrode of the first transistor is coupled to a control electrode of the drive transistor;

wherein a first electrode of the drive transistor is coupled to a first power supply, and a second electrode of the drive transistor is coupled to an anode of the light emitting device;

wherein a control electrode of the second transistor is coupled to a second scan signal terminal, a first electrode of the second transistor is coupled to a sense signal terminal, and a second electrode of the second transistor is coupled to a second electrode of the drive transistor;

wherein a first terminal of the capacitor is coupled to the control electrode of the drive transistor, and a second terminal of the capacitor is coupled to the second electrode of the drive transistor; and wherein a cathode of the light emitting device is coupled to a second power supply.

14. The driving method according to claim 13, wherein the pixel circuit further comprises a sensing element, wherein the sensing element is coupled to the data signal terminal and the sense signal terminal.

15. The driving method according to claim 14, wherein compensating the drive transistor in the second compensation manner comprises:

enabling the first transistor so that a voltage of the control electrode of the drive transistor is equal to a first voltage from the data signal terminal, and enabling the second transistor so that a voltage of the second electrode of the drive transistor is equal to a second voltage from the sense signal terminal;

continuing enabling the first transistor and disabling the second transistor so that the voltage of the second electrode of the drive transistor rises from the second voltage to a differential voltage between the first voltage and the threshold voltage of the drive transistor;

continuing enabling the first transistor, providing a data signal to the data signal terminal to enable the drive transistor, continuing disabling the second transistor so that the voltage of the second electrode of the drive transistor continues rising to charge the capacitor; and disabling the first transistor, enabling the second transistor, so that the drive transistor continues being enabled with the holding function of the capacitor, so as to continue raising the voltage of the second electrode of the drive transistor by the first power supply; causing the sense signal terminal to be in a floating state, so that a current flowing through the drive transistor is outputted to the sensing element, which calculates an external compensation voltage based on the current, and compensates the voltage of the data signal with the external compensation voltage;

wherein the second voltage is lower than the first voltage.

16. The driving method according to claim 14, wherein compensating the drive transistor in the first compensation manner comprises:

enabling the first transistor so that a voltage of the control electrode of the drive transistor is equal to a first voltage from the data signal terminal, and enabling the second transistor so that a voltage of the second electrode of the drive transistor is equal to a second voltage from the sense signal terminal;

continuing enabling the first transistor and disabling the second transistor so that the voltage of the second electrode of the drive transistor rises from the second voltage to a differential voltage between the first voltage and a threshold voltage of the drive transistor;

continuing enabling the first transistor, providing a data signal to the data signal terminal to enable the drive transistor, and continuing disabling the second transistor, so that the voltage of the second electrode of the drive transistor continues rising to charge the capacitor; and disabling the first transistor and continuing disabling the second transistor, so that the drive transistor continues being enabled with the holding function of the capacitor, so as to continue raising the voltage of the second electrode of the drive transistor by the first power supply to drive the light emitting device to emit light; wherein the second voltage is lower than the first voltage.

17. The driving method according to claim 13, wherein compensating the drive transistor in the first compensation manner comprises:

enabling the first transistor so that a voltage of the control electrode of the drive transistor is equal to a first voltage from the data signal terminal, and enabling the second transistor so that a voltage of the second electrode of the drive transistor is equal to a second voltage from the sense signal terminal;

continuing enabling the first transistor and disabling the second transistor so that the voltage of the second electrode of the drive transistor rises from the second voltage to a differential voltage between the first voltage and a threshold voltage of the drive transistor;

continuing enabling the first transistor, providing a data signal to the data signal terminal to enable the drive transistor, and continuing disabling the second transistor, so that the voltage of the second electrode of the drive transistor continues rising to charge the capacitor; and disabling the first transistor and continuing disabling the second transistor, so that the drive transistor continues being enabled with the holding function of the capacitor, so as to continue raising the voltage of the second electrode of the drive transistor by the first power supply to drive the light emitting device to emit light;

wherein the second voltage is lower than the first voltage.

18. The method according to claim 1, wherein the drive transistor is an N-type transistor.

* * * * *